US011545769B2

(12) United States Patent
Comerci et al.

(10) Patent No.: US 11,545,769 B2
(45) Date of Patent: Jan. 3, 2023

(54) LOW PROFILE EDGE CONNECTOR AND SYSTEM USING SAME

(71) Applicant: Molex, LLC, Lisle, IL (US)

(72) Inventors: Joseph D. Comerci, Lisle, IL (US); Krishnaprasad Somanath, Lisle, IL (US); Bharath Ramadasu, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/332,378

(22) PCT Filed: Nov. 29, 2016

(86) PCT No.: PCT/US2016/063977
§ 371 (c)(1),
(2) Date: Mar. 12, 2019

(87) PCT Pub. No.: WO2018/101910
PCT Pub. Date: Jun. 7, 2018

(65) Prior Publication Data

US 2021/0288417 A1 Sep. 16, 2021

(51) Int. Cl.
*H01R 12/70* (2011.01)
*H01R 4/18* (2006.01)
*H01R 12/72* (2011.01)

(52) U.S. Cl.
CPC ..... *H01R 12/7023* (2013.01); *H01R 4/184* (2013.01); *H01R 12/721* (2013.01)

(58) Field of Classification Search
CPC ... H01R 12/7023; H01R 12/721; H01R 4/184
(Continued)

(56) References Cited

U.S. PATENT DOCUMENTS 4,695,112 A * 9/1987 Maston ..... H01R 12/79 439/328
6,283,779 B1 * 9/2001 Lung ..... H01R 12/774 439/495

(Continued)

FOREIGN PATENT DOCUMENTS

CN 201355661 Y 12/2009
CN 202004190 U 10/2011

(Continued)

OTHER PUBLICATIONS

International Search report and written opinion received for PCT application No. PCT/US2016/063977, dated Aug. 17, 2017, 10 pages.

(Continued)

*Primary Examiner* — Peter G Leigh

(57) ABSTRACT

An edge connector is configured to connect to a circuit board. The edge connector includes a base wall, a first terminal mount extending upwardly from the base wall, the first terminal mount having a plurality of passageways, terminals mounted in the passageways, a second terminal mount extending upwardly from the base wall, the second terminal being spaced from the first terminal mount, the second terminal mount having a plurality of passageways extending therethrough, terminals mounted in the passageways of the second terminal mount, and a moveable latch extending from the upper surface of the base wall, the latch positioned between the first and second terminal mounts. Each terminal mount extends along part of the length of the base wall such that a platform is formed by the upper surface of the base wall rearwardly of the terminal mounts. A latch protection wall extends from each terminal mount to the rear end of the base wall, and the latch protection walls are proximate to the latch.

16 Claims, 12 Drawing Sheets

(58) Field of Classification Search
USPC ..... 439/329, 79, 83, 676
See application file for complete search history.

(56) References Cited

U.S. PATENT DOCUMENTS

| | | | | |
|---|---|---|---|---|
| 6,325,674 | B1 * | 12/2001 | Oliphant | H01R 24/62 439/329 |
| 6,341,988 | B1 | 1/2002 | Zhu et al. | |
| 6,488,543 | B2 * | 12/2002 | Oliphant | H01R 24/64 439/344 |
| 6,945,825 | B2 * | 9/2005 | Aramoto | H01R 13/64 439/680 |
| 7,850,466 | B2 * | 12/2010 | Mostoller | H01R 12/57 439/83 |
| 7,892,029 | B2 * | 2/2011 | Wang | H01R 12/82 439/607.32 |
| 7,955,112 | B2 * | 6/2011 | Yang | H01R 12/7023 439/328 |
| 8,025,507 | B2 * | 9/2011 | Kim | H01R 12/7064 439/79 |
| 8,690,589 | B2 * | 4/2014 | Ngo | H01R 12/7052 439/79 |
| 8,851,918 | B2 * | 10/2014 | Yoshisuji | H01R 13/639 439/495 |
| 2005/0196995 | A1 | 9/2005 | Cheng et al. | |
| 2010/0167570 | A1 | 7/2010 | Yang et al. | |
| 2010/0255705 | A1 | 10/2010 | Higuchi | |
| 2011/0300759 | A1 | 12/2011 | Ngo | |
| 2012/0077365 | A1 * | 3/2012 | Kobayashi | H01R 12/712 439/345 |
| 2018/0212361 | A1 * | 7/2018 | Eppley | H01R 13/6275 |

FOREIGN PATENT DOCUMENTS

| | | | |
|---|---|---|---|
| CN | 202150590 | U | 2/2012 |
| CN | 103633488 | A | 3/2014 |
| CN | 104716510 | A | 6/2015 |
| JP | 2008-153059 | A | 7/2008 |
| JP | 2010-176923 | A | 8/2010 |
| WO | 2018/101910 | A1 | 6/2018 |

OTHER PUBLICATIONS

International Preliminary report on patentability received for PCT application No. PCT/US2016/063977, dated Jun. 13, 2019, 9 pages.
Office Action received for CN Application No. 201680090996.7, dated Feb. 6, 2020, 17 Pages (09 Pages of English translation and 08 Pages of Official notification).

* cited by examiner

LOW PROFILE EDGE CONNECTOR AND SYSTEM USING SAME

This application claims priority to PCT application No. PCT/US2016/063977, filed on Nov. 29, 2016, which is incorporated herein by reference in its entirety.

FIELD OF THE DISCLOSURE

This disclosure relates to field of connectors, more specifically to the field of connectors that can mount to an edge of a circuit board.

DESCRIPTION OF RELATED ART

Connectors that can mount to an edge of a circuit board are known. Existing designs, while function, tend to have a higher than desirable profile while requiring more board real estate than is desired. Consequentially, certain individuals would appreciate an improved connector for mounting to an edge of a circuit board.

SUMMARY OF THE DISCLOSURE

A connector is configured to mount to an edge of a circuit board. The edge connector has a low profile and is releasable while providing for a secure and robust electrical connection. An edge connector is configured to connect to a circuit board. The edge connector includes a base wall, a first terminal mount extending upwardly from the base wall, the first terminal mount having a plurality of passageways, terminals mounted in the passageways, a second terminal mount extending upwardly from the base wall, the second terminal being spaced from the first terminal mount, the second terminal mount having a plurality of passageways extending therethrough, terminals mounted in the passageways of the second terminal mount, and a moveable latch extending from the upper surface of the base wall, the latch positioned between the first and second terminal mounts. Each terminal mount extends along part of the length of the base wall such that a platform is formed by the upper surface of the base wall rearwardly of the terminal mounts. A latch protection wall extends from each terminal mount to the rear end of the base wall, and the latch protection walls are proximate to the latch.

BRIEF DESCRIPTION OF THE DRAWINGS

The present invention is illustrated by way of example and not limited in the accompanying figures in which like reference numerals indicate similar elements and in which.

DETAILED DESCRIPTION OF THE ILLUSTRATED EMBODIMENT

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
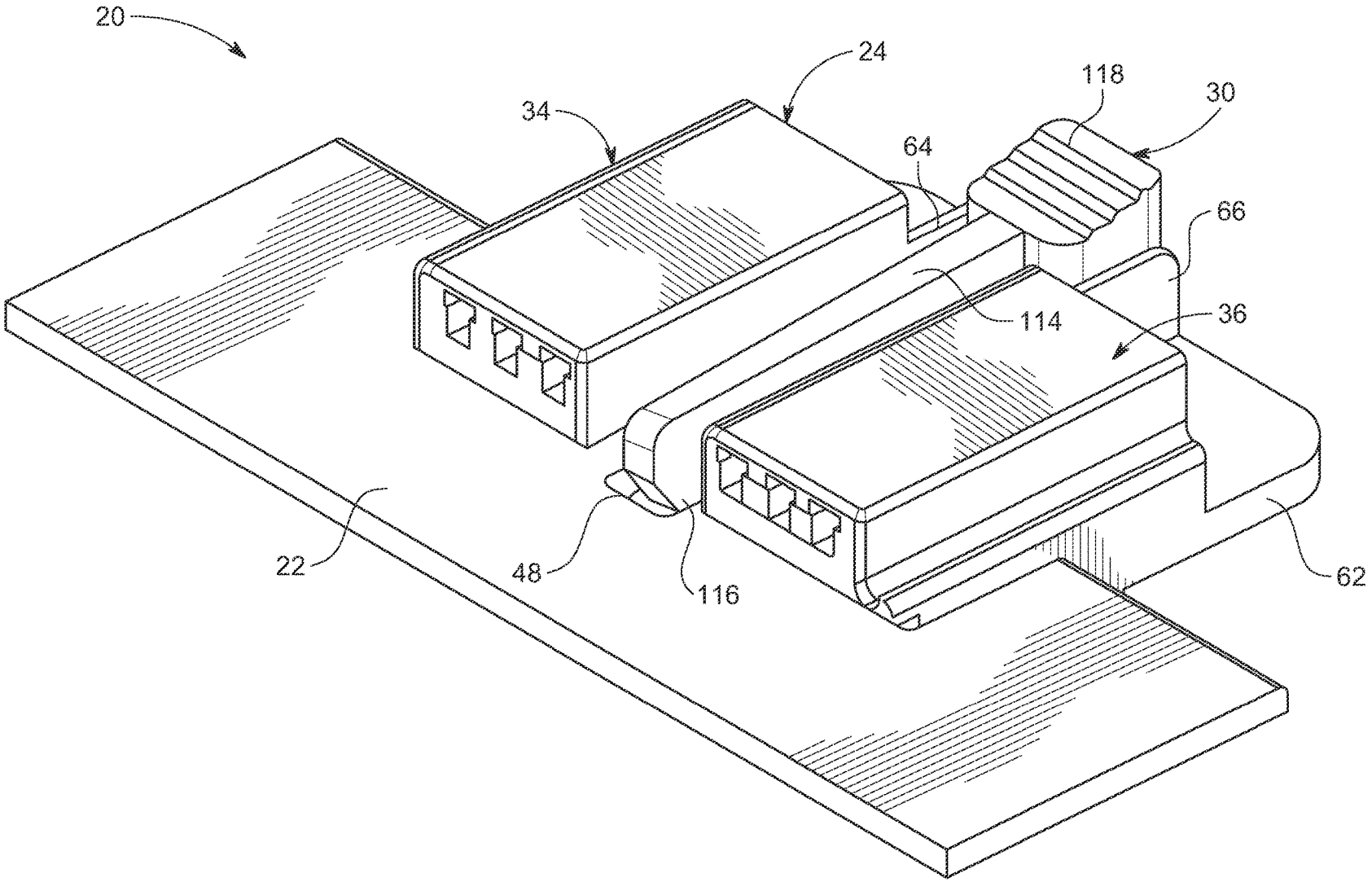
FIG. 1 depicts a perspective view of a connector system which includes an embodiment of a low profile edge connector.

As shown in FIG. 1, a connector system 20 includes a circuit board 22 that is configured to mate with a low profile edge connector 24. The low profile edge connector 24 includes a housing 26 that supports a plurality of terminals 28. The housing 26, which can be formed of an insulative material, includes an integral latch 30 which is configured to attach the edge connector 24 to the circuit board 22. The housing 26 allows for a touch safe connector and has a circuit board receiving slot 32 that is configured to engage the circuit board 22. The housing 26 is designed to direct the circuit board 22 into the circuit board receiving slot 32. In an embodiment, the edge connector 24 includes first and second terminal mounts 34, 36 in which the terminals 28 are mounted, with the latch 30 positioned between the terminal mounts 34, 36. The terminals 28 mate with the circuit board 22. Directional terms such as front, rear, upper, lower and the like are used herein for ease in describing the edge connector 24. The use of these terms does not denote a required orientation of the edge connector 24 during assembly and during use.

Figure 2:
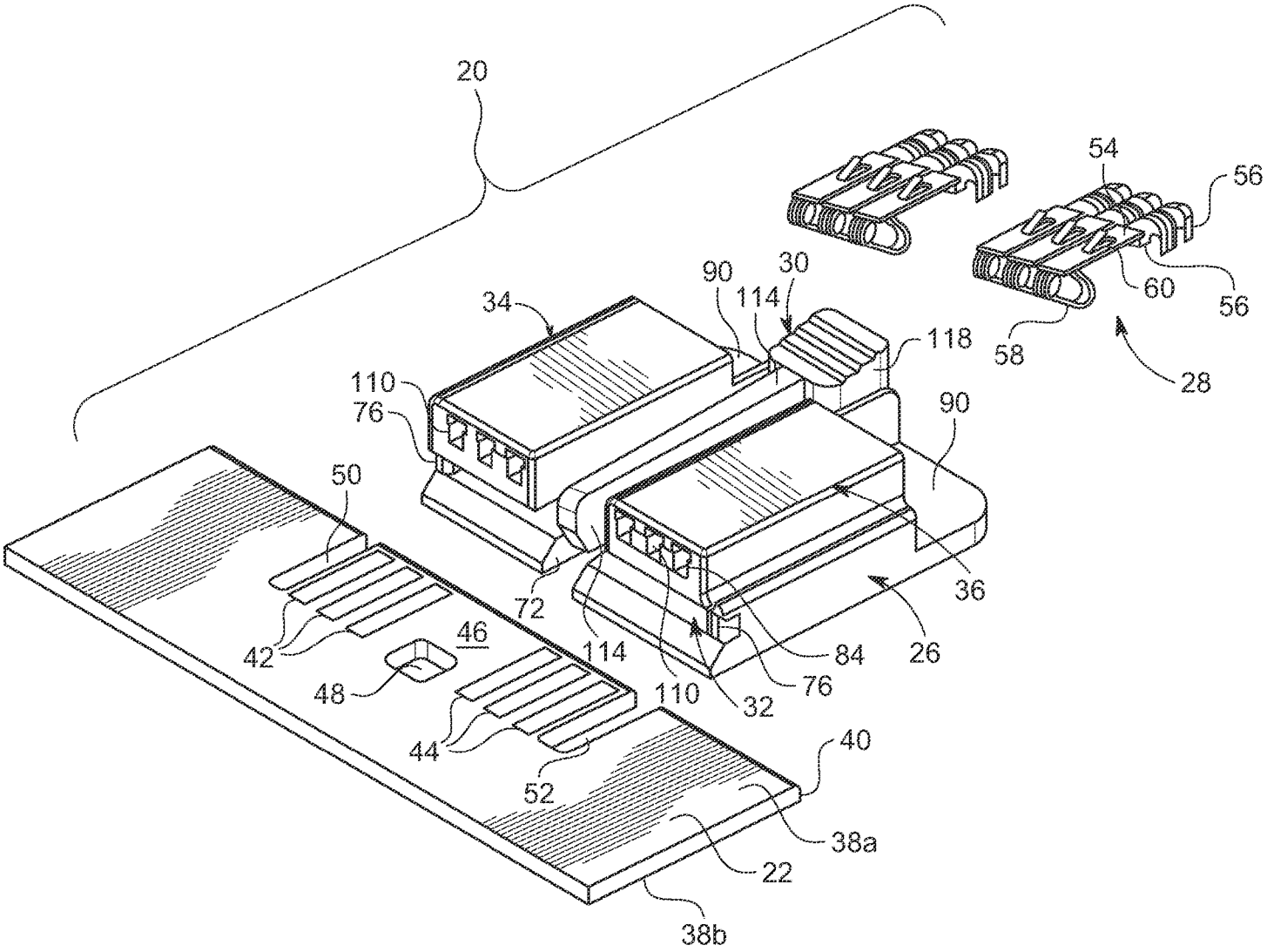
FIG. 2 depicts an exploded perspective view of the connector system.

The circuit board 22 is formed in a known manner. As best shown in FIG. 2, the circuit board 22 has planar upper and lower surfaces 38*a*, 38*b*, and edges, at least one edge 40 of which is at least partially planar. Two sets 42, 44 of spaced apart contact pads are provided on the upper surface 38*a* proximate to the edge 40. Because the sets 42, 44 are spaced apart from each other, a space 46 is provided between the sets 42, 44 of contact pads. A locking aperture 48 is provided through the circuit board 22 in the space 46. A first slot 50 extends from the edge 40 adjacent to the first set 42 of contact pads. A second slot 52 extends from the edge 40 adjacent to the second set 44 of contact pads. The slots 50, 52 have different widths.

As best shown in FIG. 2, each terminal 28 is formed from a planar body 54, a plurality of legs 56 extending from a rear end of the body 54, a curved contact 58 extending from the front of the body 54, and a tang 60 extending upwardly from the body 54. In use, the legs 56 are crimped to an associated wire (not shown). In an embodiment, the terminals 28 can have a double beam structure that allows the terminal 28 to have a desirable normal force without requiring a thick terminal contact.

As shown in FIGS. 3-12, the housing 26 is formed from a base wall 62, the first terminal mount 34 which extends upwardly from the base wall 62, the second terminal mount 36 which extends upwardly from the base wall 62, a first latch protection wall 64 extending from the first terminal mount 34, a second latch protection wall 66 extending from the second terminal mount 36, and the latch 30 which extends from the base wall 62 and is provided between the terminal mounts 34, 36 and between the latch protection walls 64, 66.

The base wall 62 has a planar upper surface 68*a*, a lower surface 68*b* which may be planar, opposite side edges 68*c*, 68*d*, a front edge 68*e* and a rear edge 68*f*. The corners between the edges 68*c*, 68*d*, 68*e*, 68*f* may be rounded. The front edge 68*e* of the base wall 62 has a chamfer 70 such that the front edge 68*e* is angled inwardly and rearwardly from the lower surface 68*b* to the upper surface 68*a*. A cutout 72 is provided in the front edge 68*e* and is between the terminal mounts 34, 36.

Each terminal mount 34, 36 has a front end 74*a*, a rear end 74*b*, outer side walls 76, 78 which extend upwardly from the base wall 62, at least one dividing wall 80 which extends upwardly from the base wall 62 and is positioned between the side walls 76, 78, a top wall 82 which joins the upper ends of the side and dividing walls 76, 78, 80 together and forms the top surface 74*c* of the terminal mounts 34, 36, and a front wall 84 which joins the forward ends of the side and dividing walls 76, 78, 80 together and forms the front end 74*a* of the first terminal mount 34. The front wall 84 has a chamfer 86 on its lower edge. Passageways 88 are formed by the walls 76, 78, 80, 82. The terminal mounts 34 extend from the front edge 68*e* of the base wall 62 rearwardly a predetermined distance, but do not extend the entire distance of the base wall 62. As such, a platform 90 is defined by the upper surface 68*a* of the base wall 62 between the rear end 74*b* of each terminal mount 34 and the rear end 68*f* of the base wall 62.

Each side wall 76 has side surfaces 92*a*, 92*b*, a front face 92*c* and a rear face 92*d*. The front face 92*c* is proximate to the top of the chamfer 70 and the side wall extends along the side edges 68*c*, 68*d*, respectively, of the base wall 62 rearwardly a predetermined distance. A thickness of each side wall 76 is defined at the front face 92*c* and these thicknesses correspond to the sizes of the respective slots 50, 52. As shown T1 denotes the thickness of the side wall 76 of the first terminal mount 34 and T2 denotes the thickness of the side wall 76 of the second terminal mount 36, and it can be seen that the side wall 76 of the second terminal mount 36 has a greater thickness T2 than the thickness T1 of the side wall 76 of the first terminal mount 34. A generally L-shaped recess 94 is formed in the side surface 92*b* of the side walls 76. The terminals 28 seats within the L-shaped recess 94.

Each dividing wall 80 is generally L-shaped having a forward wall portion 96 and a rearward wall portion 98. The forward wall portion 96 extends downwardly from the top wall 82 a predetermined distance, such that the circuit board receiving slot 32 is formed between the forward wall portion 96 and the base wall 62. The rearward wall portion 98 extends rearwardly from the forward wall portion 96 to the rear end 74*b* of the respective terminal mount 34, 36 and extends between the base wall 62 and the top wall 82. A generally L-shaped recess 100 is formed in each side surface of the dividing walls 80. The terminals 28 seats within the L-shaped recess 100.

Each side wall 78 is generally L-shaped having a forward wall portion 102 and a rearward wall portion 104. The forward wall portion 102 extends downwardly from the top wall 82 a predetermined distance, such that the circuit board receiving slot 32 is formed between the forward wall portion 102 and the base wall 62. The rearward wall portion 104 extends rearwardly from the forward wall portion 102 to the rear end 74*b* of the respective terminal mount 34, 36 and extends between the base wall 62 and the top wall 82. A generally L-shaped recess 106 is formed in the side surface of the side wall 78. The terminals 28 seats within the L-shaped recess 106.

The passageways 88 are formed by the walls 76, 78, 80, 82. Each passageway 88 has an open rearward end and an open forward end which communicates with the circuit board receiving slot 32.

The top wall 84 has a plurality of downwardly extending protrusions 108 which extend partially into the respective passageways 88.

Figure 12:
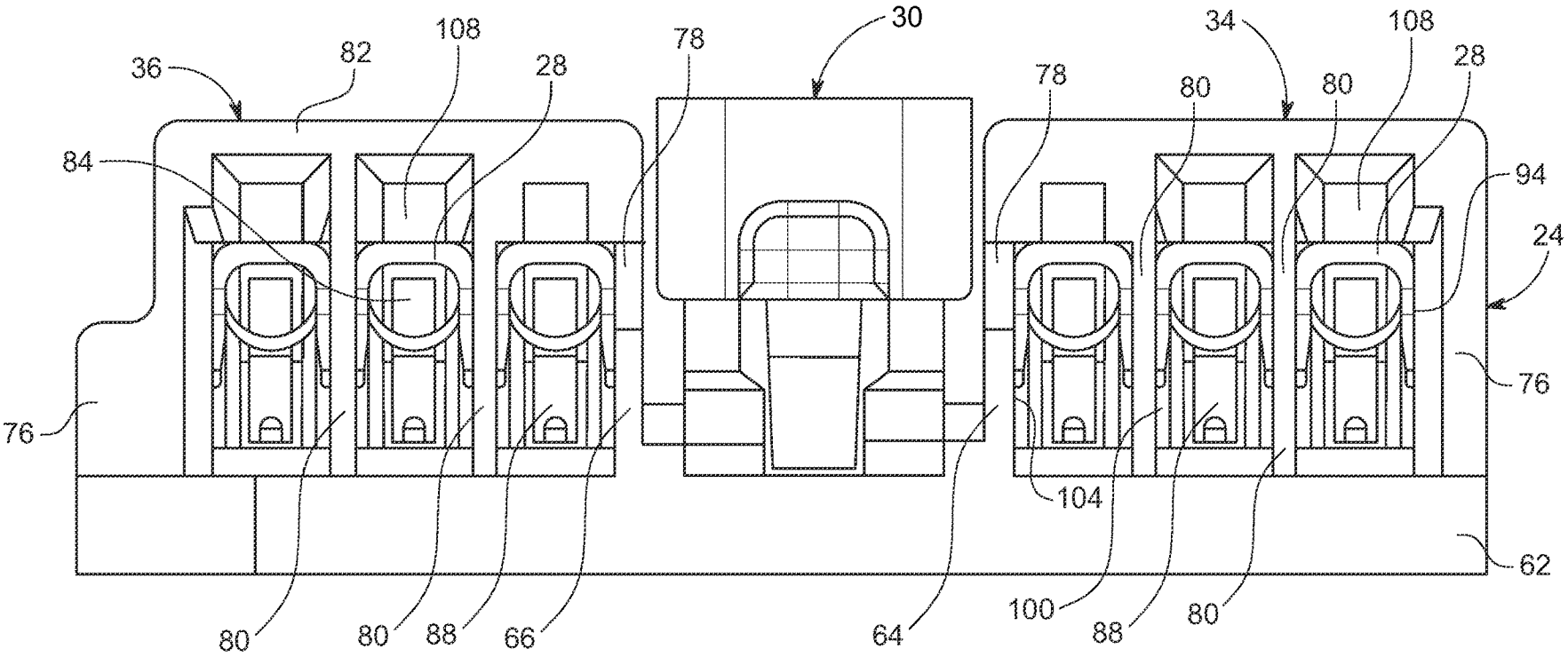
FIG. 12 depicts a rear perspective view of the low profile edge connector.

As shown in FIG. 12, when the terminals 28 are inserted into the passageways 88, the sides of the body 54 and the legs 56 of the terminals 28 seat within the recesses 94, 100, 106 and the tangs 60 engage with the protrusions 108. The engagement of the tangs 60 with the protrusions 108 prevent the terminals 28 from being released from the housing 26. The curved contacts 58 of the terminals 28 extend downwardly into the circuit board receiving slot 32. The lowermost extent of the curved contacts 58 are spaced from the upper surface 68*a* of the base wall 62.

Figure 3:
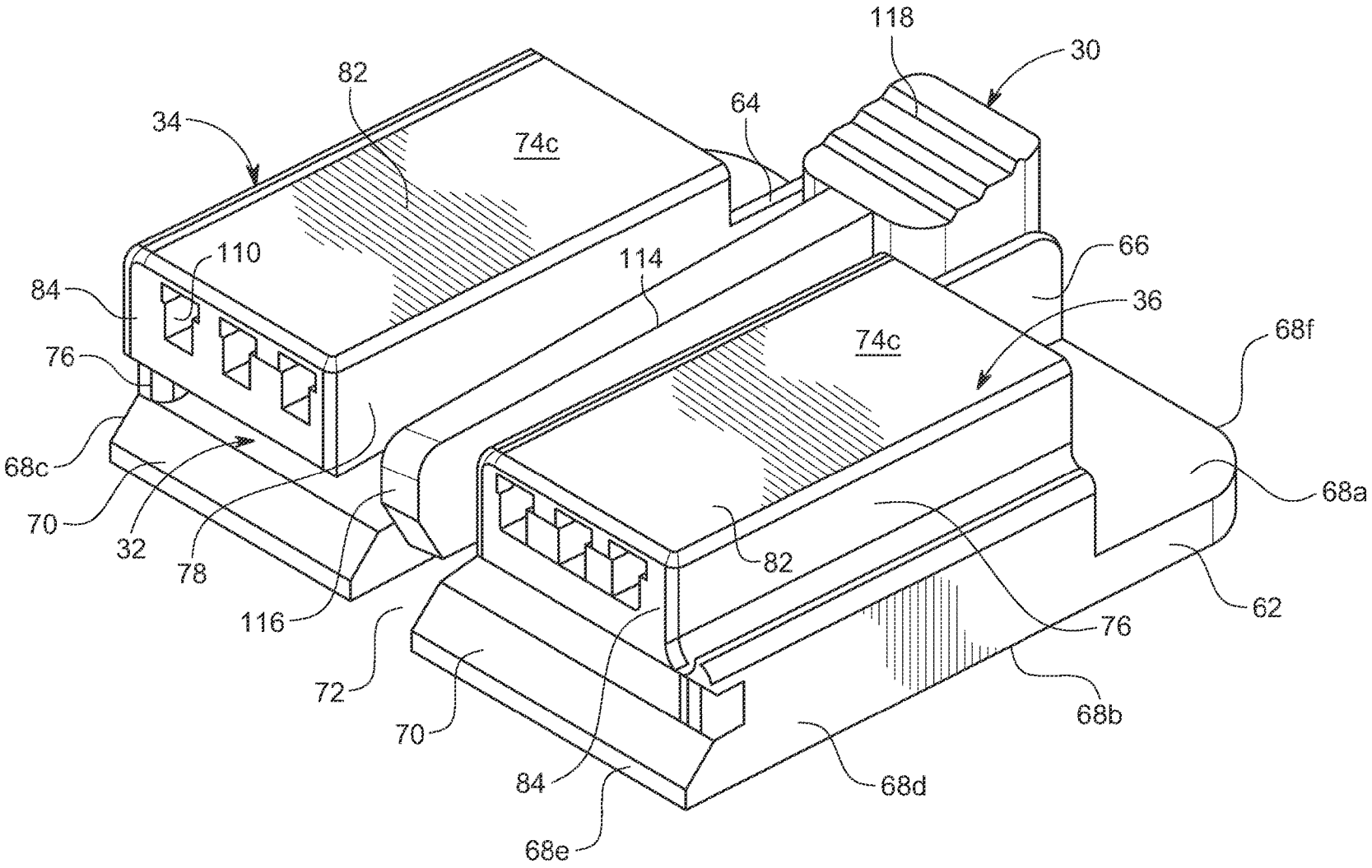
FIG. 3 depicts a perspective view of the low profile edge connector.
Figure 4:
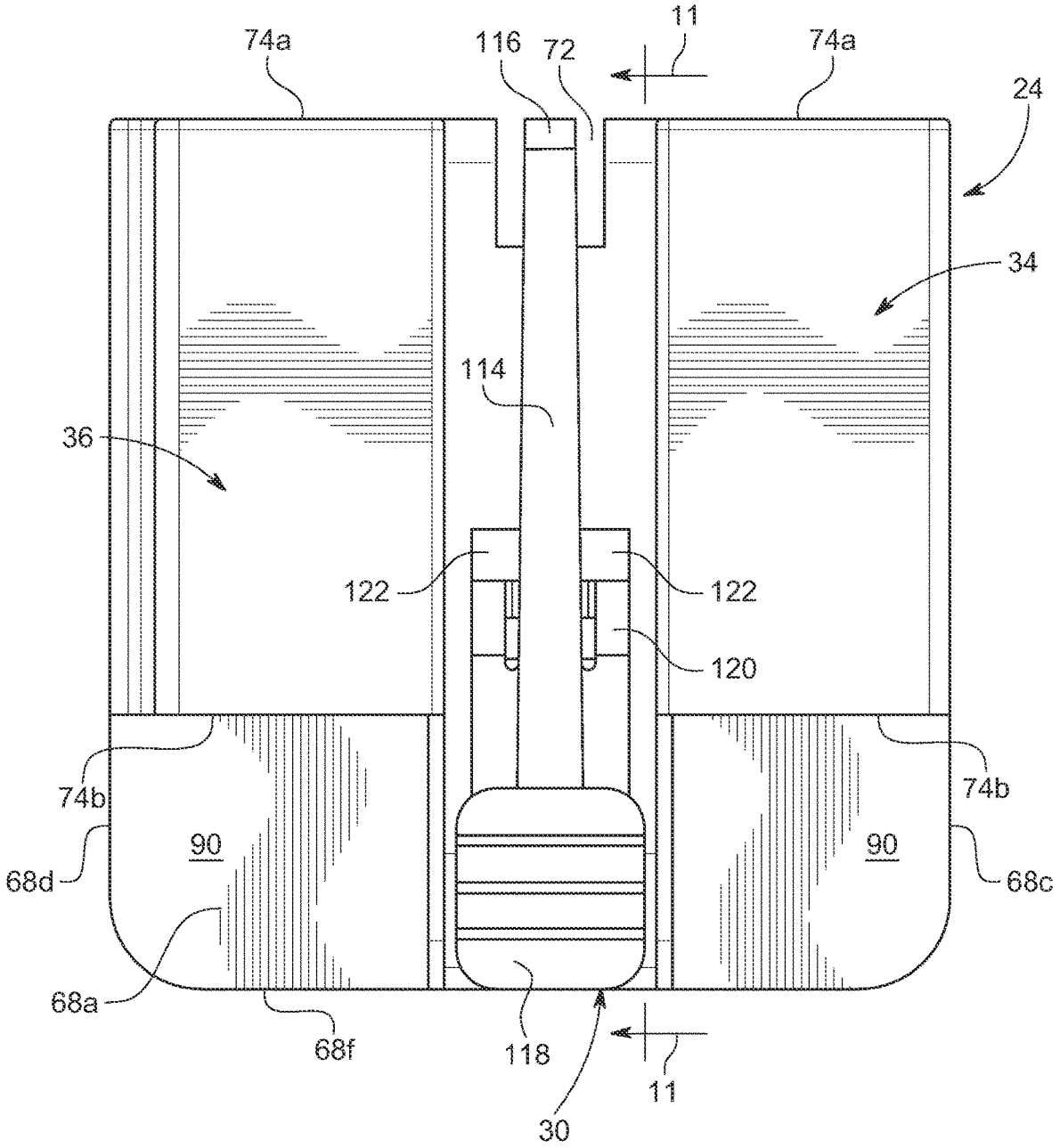
FIG. 4 depicts a top plan view of the housing of the low profile edge connector.
Figure 5:
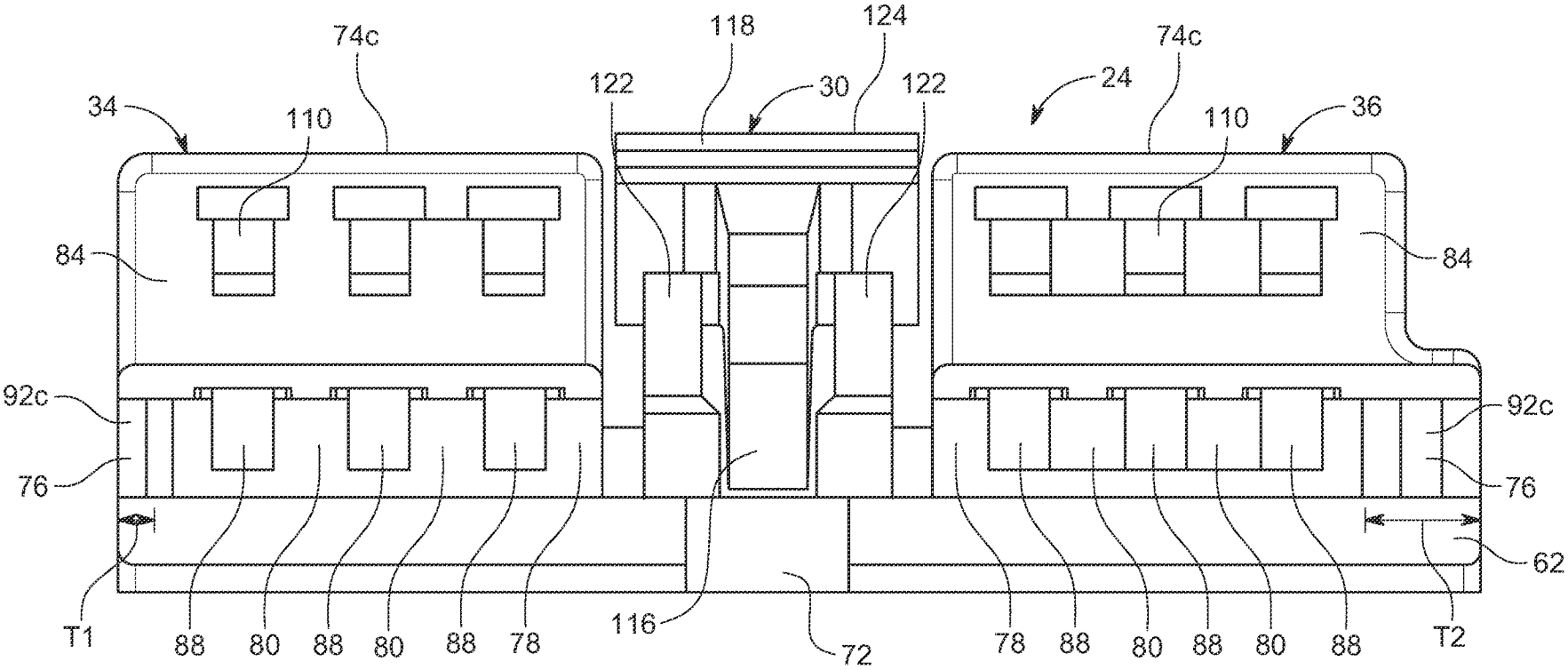
FIG. 5 depicts a front plan view of the housing of the low profile edge connector.
Figure 6:
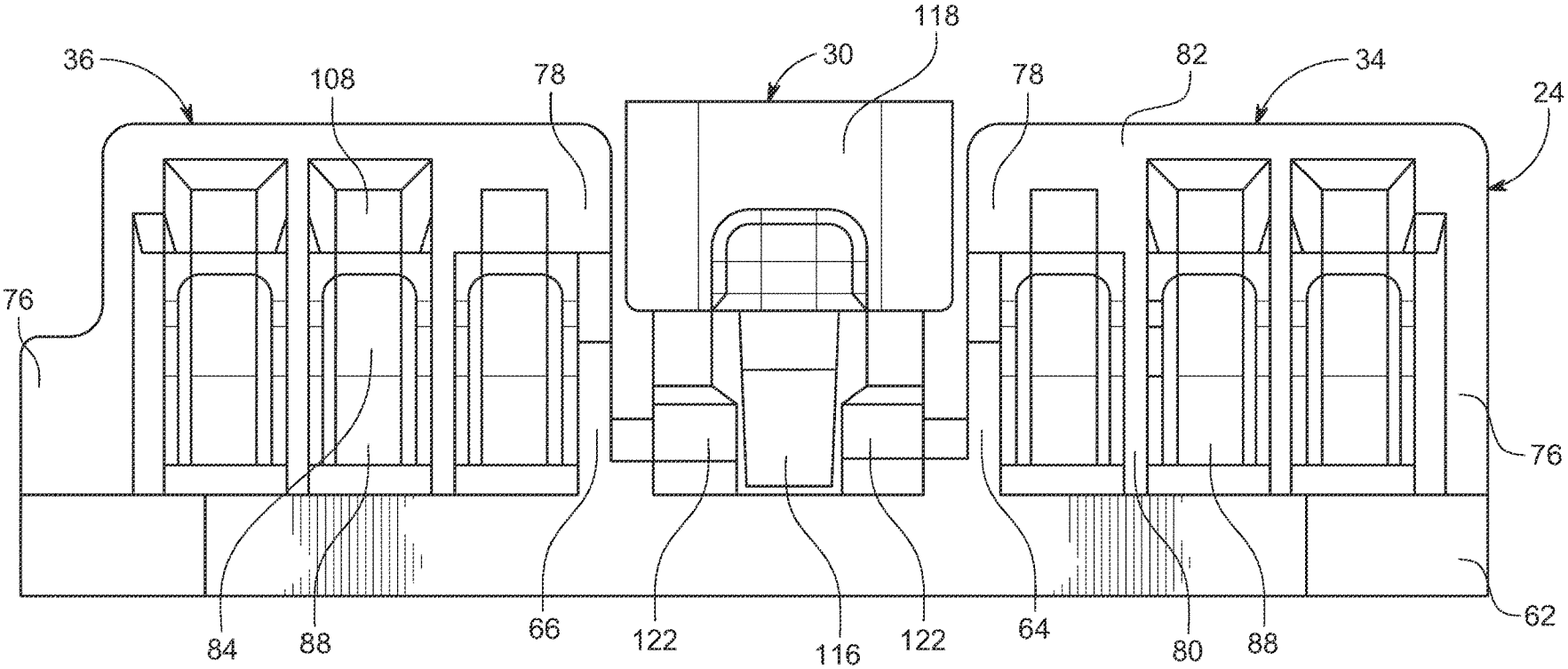
FIG. 6 depicts a front plan view of the housing of the low profile edge connector.
Figure 7:
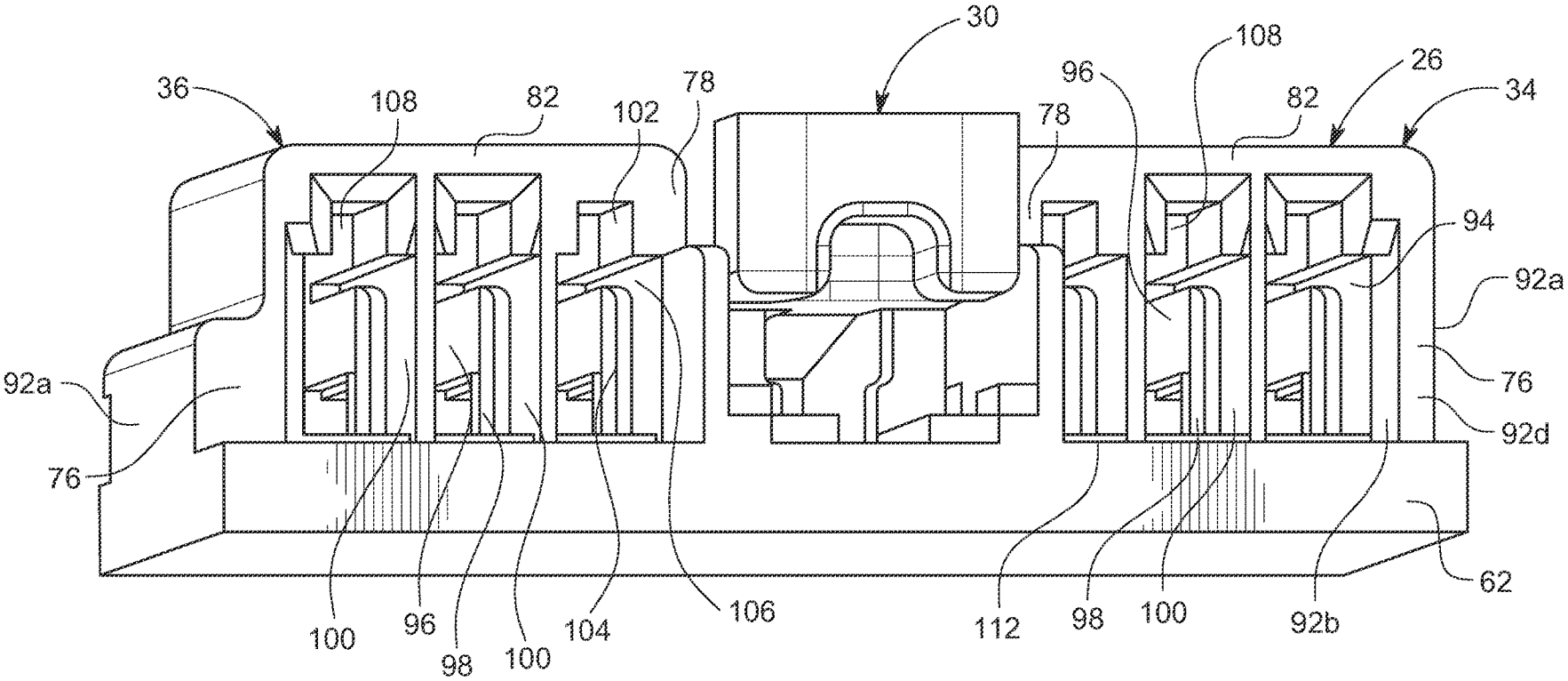
FIG. 7 depicts a rear perspective view of the housing of the low profile edge connector.
Figure 8:
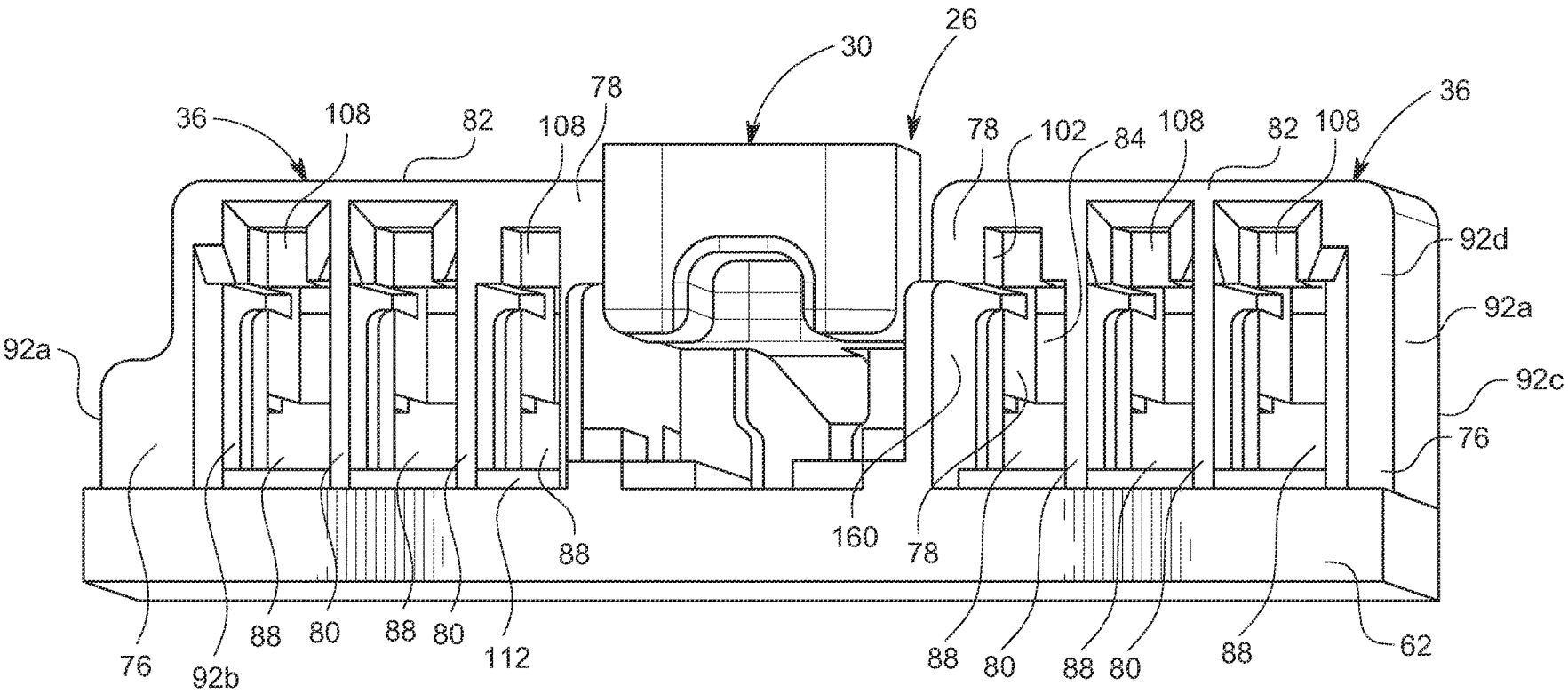
FIG. 8 depicts an alternate rear perspective view of the housing of the low profile edge connector.

The front wall 84 closes a portion of the passageways 88. As shown in FIGS. 3 and 5, the front wall 84 may have a plurality of apertures 110 therethrough which are in communication with the passageways 88. The apertures 110 may be T-shaped as shown, or may take other forms. When the circuit board 22 is inserted into the circuit board receiving slot 32 to engage the sets 42, 44 with the terminals 28, a probe (not shown) may be inserted through desired ones of the apertures 110 to make electrical contact with the terminal 28 proximate to the particular aperture 110. An electrical test can then be performed to ensure that proper contact has been made between the terminal 28 and the circuit board 22.

A raised pad 112 may extend upwardly from the base wall 62 along the bottom of each of the passageways 88.

The latch 30 extends from the upper surface 68*a* of the base wall 62 between the terminal mounts 34, 36. The latch 30 is formed from a cantilevered arm 114 having an engaging member 116 at an end which is capable of engaging within the locking aperture 48 in the circuit board 22, and a cantilevered actuation shoulder 118 that are each provided on opposite sides of a fulcrum 120. The arm 114 extends parallel to the side walls 78. The engaging member 116 aligns with the cutout 72 in the base wall 62. The actuation shoulder 118 is attached to the end of the arm 114 and is provided between the latch protection walls 64, 66. In an embodiment, the engaging member 116 may be a hook. In an embodiment, the fulcrum 120 may be double fulcrum. In an embodiment, the fulcrum 120 may be a single fulcrum. As shown, the fulcrum 120 is formed by a pair of curved legs 122 which generally form an L-shape. A first part 122*a* of each leg 122 extends upwardly from the upper surface 68*a* of the base wall 62 and a second part 122*b* of each leg 122 extends generally parallel to the upper surface 68*a* of the base wall 62. The second part 122*b* of each leg 122 is connected to the arm 114.

The actuation shoulder 118 has an upper surface 124 which a digit of a user can engage to actuate the latch 30. When viewed from the side of the housing 26, see FIG. 9, the upper surface 124 is flush with, or slightly above, the top surfaces 74*c* of the terminal mounts 34, 36. The upper surface 124 may be ribbed or embossed to promote gripping by the user's digit. In an at-rest position as described herein, a lower surface 126 of the actuation shoulder 118 is spaced from the base wall 62 by a distance D. Since latch 30 is positioned between the terminal mounts 34, 36 and the upper surface 124 is flush with, or slightly above, the top surfaces 74*c* of the terminal mounts 34, 36, a low profile edge connector 24 is provided. The edge connector 24 may have a height of 6.75 mm such a height being defined between the lower surface 68*b* of the base wall 62 and the upper surface 124 of the actuation shoulder 118.

Figure 11:
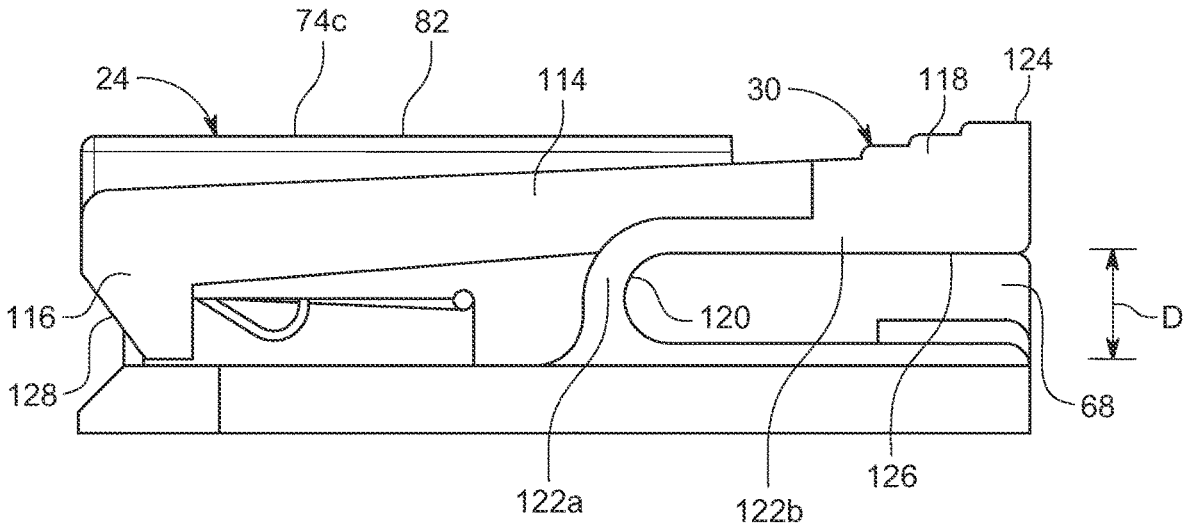
FIG. 11 depicts a cross-sectional view of the housing of the low profile edge connector along line 11-11 of FIG. 4.

When the latch 30 is in an at-rest position as shown in FIG. 11, the engaging member 116 is in close proximity to the cutout 72 and may extend into the cutout 72. When the actuation shoulder 118 is depressed to move the latch 30 to an activated position, the actuation shoulder 118 moves closer to the base wall 62, the legs 122*a*, 122*b* flex, and the engaging member 116 moves away from the base wall 62. When the pressure is released, the latch 30 resumes its at-rest position.

To engage the circuit board 22 with the edge connector 24, the actuation shoulder 118 of the latch 30 is depressed to move the latch 30 to an activated position. This moves the engaging member 116 out of the circuit board receiving slot 32. The latch 30 may be designed such that the engaging member 116 is moved completely out of the circuit board receiving slot 32, or partially out of the circuit board receiving slot 32. The circuit board 22 is then inserted into the circuit board receiving slot 32 and the sets 42, 44 of pads on the circuit board 22 mate with the curved contacts 58 of the terminals 28 in order to form an electrical path between the circuit board 22 and the edge connector 24. The chamfers 70, 86 promote the entry of the circuit board 22 into the circuit board receiving slot 32 and the engaging member 116 may have a chamfer 128 on the surface which faces the circuit board 22 to assist in entry of the circuit board 22 into the circuit board receiving slot 32. The side walls 76 seat within the respective slots 50, 52 in the circuit board 22. Since each slot 50, 52 in the circuit board 22 is sized to receive only one of the side walls 76, the edge connector 24 cannot be inserted upside down onto the circuit board 22. Once the circuit board 22 is fully inserted, the latch 30 is released to move the latch 30 to the at-rest position. As shown in FIG. 1, when in the at-rest position, the engaging member 116 engages within the locking aperture 48. This engagement prevents the removal of the edge connector 24 from the circuit board 22. The circuit board 22 can be released from the edge connector 24 by depressing the actuation shoulder 118 to move the latch 30 to the activated position. This removes the engaging member 116 from the locking aperture 48 and the circuit board 22 can be pulled out from circuit board receiving slot 32 of the edge connector 24. Thereafter, the actuation shoulder 118 is released to move the latch 30 to the at-rest position.

Figure 9:
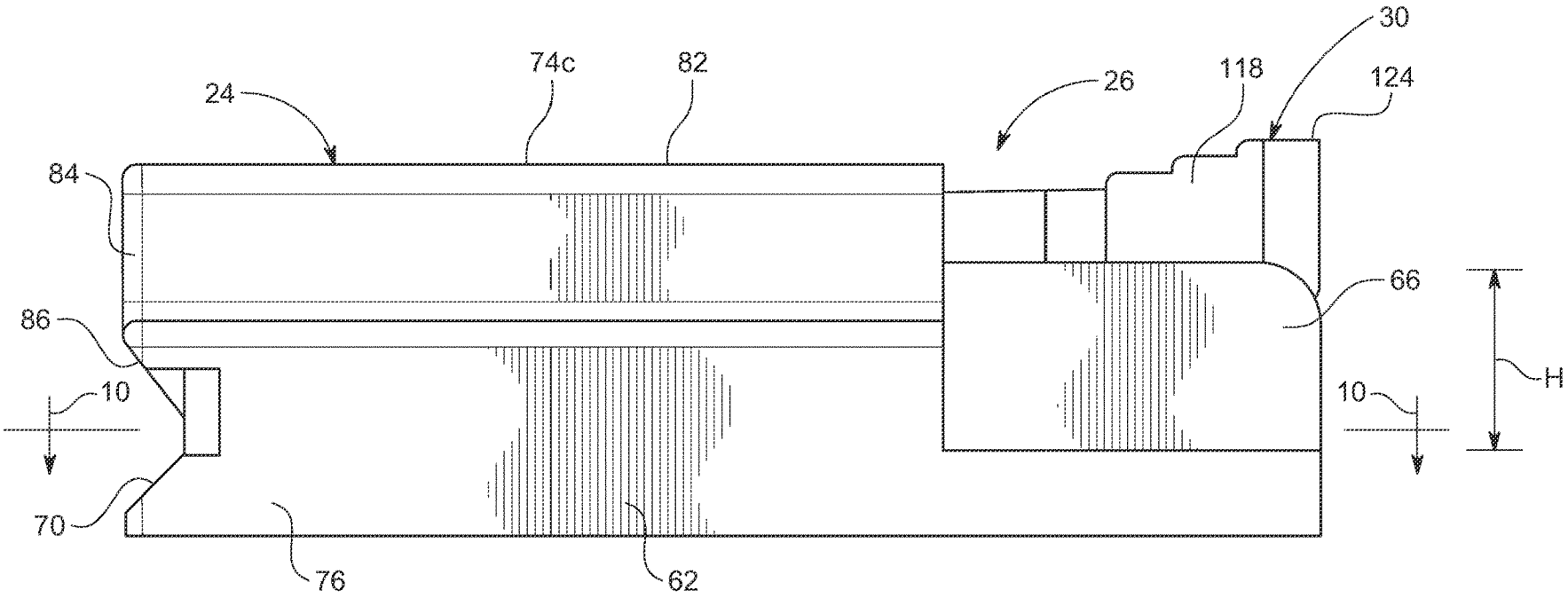
FIG. 9 depicts a side elevation view of the housing of the low profile edge connector.
Figure 10:
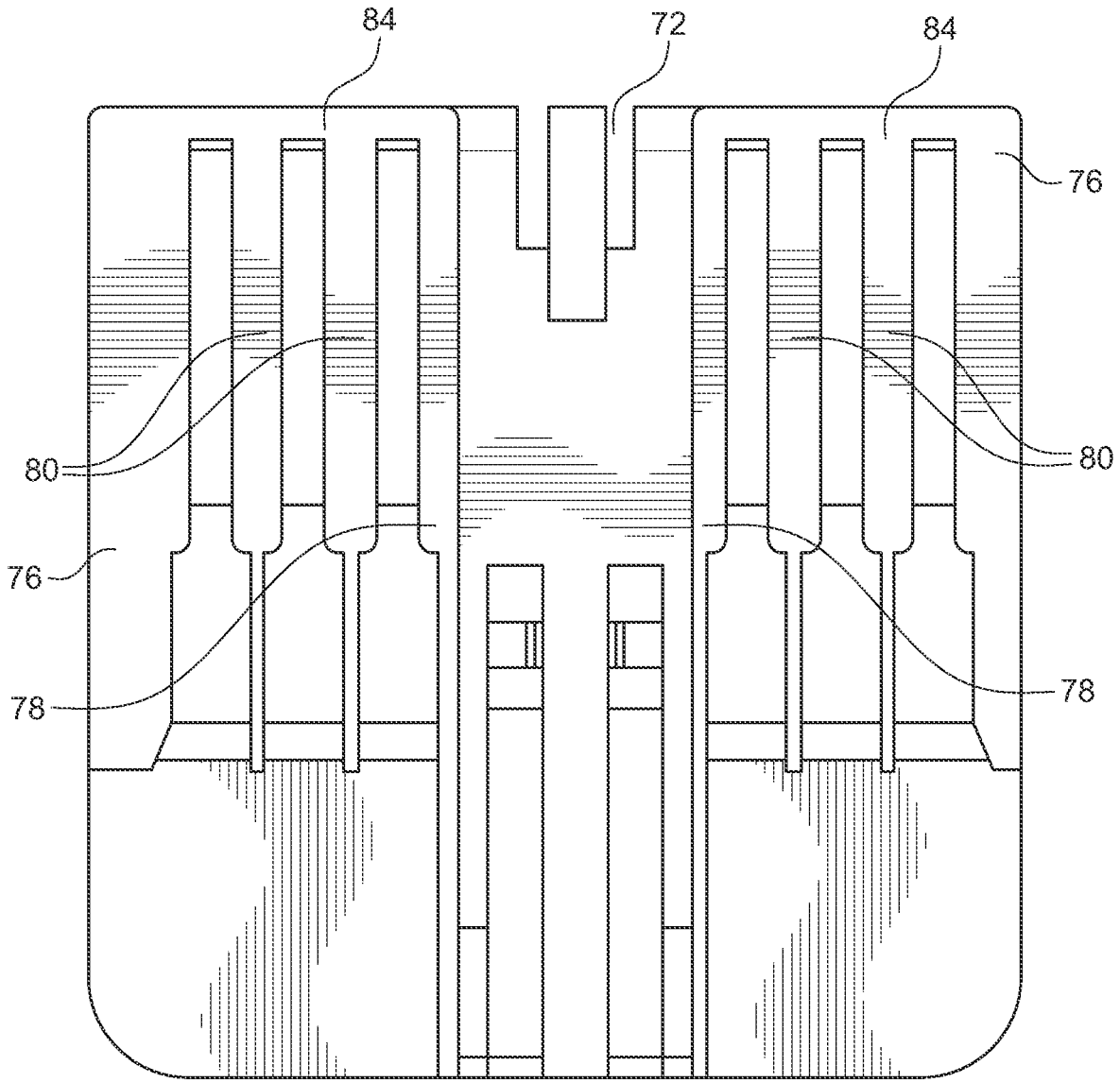
FIG. 10 depicts a cross-sectional view of the housing of the low profile edge connector along line 10-10 of FIG. 9.

As discussed herein, the legs 56 of the terminals 28 are crimped to an associated wire (not shown) which extends outwardly from a rear end 68*f* of the edge connector 24. The wires lay on the platform 90 formed by the base wall 62. As shown in FIGS. 9 and 11, the latch protection walls 64, 66 have a height H which is at least equal to the distance D that the the lower surface 126 of the actuation shoulder 118 is spaced from the base wall 62 when the latch 30 is in the at-rest position. The latch protection walls 64, 66 prevent the wires from being able to move underneath the actuation shoulder 118. This prevents damage to the latch 30 and to the wires which may otherwise occur if the wires were pinched under the latch 30. In addition, the latch protection walls 64, 66 ensure consistent use of the edge connector 24 since the wires cannot move under the latch 30 which would impede/prevent actuation of the latch 30.

While the drawings show that each terminal mount 34, 36 includes three terminals, it is to be understood that two passageways 88 may be provided through each terminal mount 34, 36, or more than three passageways 88 may be provided through each terminal mount 34, 36.

In addition, while a single latch 30 is shown, the base wall 62 could be elongated to provide another latch and another terminal mount (and so forth depending upon how many terminal mounts are desired). If multiple latches are provided, the latches may be coupled together such that actuation of one of the latches causes actuation of the remainder of the latches.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An edge connector configured to connect to a circuit board, the edge connector comprising:

a base wall having a front edge, a rear edge, an upper surface and a lower surface;

a first terminal mount extending upwardly from the upper surface of the base wall, the first terminal mount having a plurality of first passageways extending therethrough;

first terminals mounted in the plurality of first passageways;

a second terminal mount extending upwardly from the upper surface of the base wall, the second terminal mount being spaced from the first terminal mount, the second terminal mount having a plurality of second passageways extending therethrough;

second terminals mounted in the plurality of second passageways; and a moveable latch extending from the upper surface of the base wall, the latch positioned between the first and second terminal mounts, wherein each terminal mount extends along part of the length of the base wall such that a platform is formed by the upper surface of the base wall rearwardly of the terminal mounts, and further comprising a latch protection wall extending from each terminal mount to the rear edge of the base wall, the latch protection walls being proximate to the latch.

2. The edge connector of claim 1, wherein the first terminal mount includes a pair of first outer side walls, at least one first dividing wall provided between the first outer side walls and spaced from the first outer side walls, and a first top wall attached to an upper end of each of the first outer side and dividing walls, the first outer side, dividing and top walls forming the plurality of first passageways through the first terminal mount, and the first outer side, dividing and top walls forming a first circuit board receiving slot at a front end of the first terminal mount; and the second terminal mount includes a pair of second outer side walls, at least one second dividing wall provided between the second outer side walls and spaced from the second outer side walls, and a second top wall attached to an upper end of each of the second outer side and dividing walls, the second outer side, dividing and top walls forming the plurality of second passageways through the second terminal mount, and the second outer side, dividing and top walls forming a second circuit board receiving slot at a front end of the second terminal mount, the second circuit board receiving slot aligning with the first circuit board receiving slot.

3. The edge connector of claim 2, wherein one of the first outer side walls has a width which is wider than one of the second outer side walls.

4. The edge connector of claim 1, wherein the latch includes a hook.

5. The edge connector of claim 4, wherein the base wall further comprises a cutout therein, the cutout aligning with the hook.

6. The edge connector of claim 1, wherein the latch is connected to the base wall by a fulcrum, the latch having a cantilevered arm connected to the fulcrum, the arm having opposite first and second ends, an engaging member at the first end of the arm, the engaging member being capable of engaging with an associated circuit board, and an actuation shoulder at the second end of the arm, the actuation shoulder configured to be engaged for depression.

7. The edge connector of claim 6, wherein a top surface of the actuation shoulder is substantially flush with a top surface of the terminal mounts.

8. The edge connector of claim 6, wherein an uppermost extent of the latch is substantially flush with a top surface of the terminal mounts.

9. The edge connector of claim 1, wherein the first and second outer side and dividing walls have recesses therein configured to engage the first and second terminals, respectively.

10. The edge connector of claim 1, wherein each terminal includes a planar body, a curved contact and at least one pair of legs, the legs being capable of being crimped to an associated wire, and a tang extending upwardly from the body, the terminal mounts including a protrusion which engages with the tang.

11. An edge connector configured to connect to a circuit board, the edge connector comprising:

a base wall having a front edge, a rear edge, an upper surface and a lower surface;

a first terminal mount extending upwardly from the upper surface of the base wall, the first terminal mount having a plurality of first passageways extending therethrough;

first terminals mounted in the plurality of first passageways;

a second terminal mount extending upwardly from the upper surface of the base wall, the second terminal mount being spaced from the first terminal mount, the second terminal mount having a plurality of second passageways extending therethrough;

second terminals mounted in the plurality of second passageways; and a moveable latch extending from the upper surface of the base wall, the latch positioned between the first and second terminal mounts, wherein the latch includes a hook, and wherein the base wall further comprises a cutout therein, the cutout aligning with the hook.

12. An edge connector configured to connect to a circuit board, the edge connector comprising:

a base wall having a front edge, a rear edge, an upper surface and a lower surface;

a first terminal mount extending upwardly from the upper surface of the base wall, the first terminal mount having a plurality of first passageways extending therethrough;

first terminals mounted in the plurality of first passageways;

a second terminal mount extending upwardly from the upper surface of the base wall, the second terminal mount being spaced from the first terminal mount, the second terminal mount having a plurality of second passageways extending therethrough;

second terminals mounted in the plurality of second passageways; and a moveable latch extending from the upper surface of the base wall, the latch positioned between the first and second terminal mounts, wherein an uppermost extent of the latch is substantially flush with a top surface of the first and second terminal mounts, wherein the latch is connected to the base wall by a fulcrum, the latch having a cantilevered arm connected to the fulcrum, the arm having opposite first and second ends, an engaging member at the first end of the arm, the engaging member being capable of engaging with an associated circuit board, and an actuation shoulder at the second end of the arm, the actuation shoulder configured to be engaged for depression, and wherein a top surface of the actuation shoulder is substantially flush with a top surface of the terminal mounts.

13. An edge connector configured to connect to a circuit board, the edge connector comprising:

a base wall having a front edge, a rear edge, an upper surface and a lower surface;

a first terminal mount extending upwardly from the upper surface of the base wall, the first terminal mount having a plurality of first passageways extending therethrough;

first terminals mounted in the plurality of first passageways;

a second terminal mount extending upwardly from the upper surface of the base wall, the second terminal mount being spaced from the first terminal mount, the second terminal mount having a plurality of second passageways extending therethrough;

second terminals mounted in the plurality of second passageways; and a moveable latch extending from the upper surface of the base wall, the latch positioned between the first and second terminal mounts, wherein an uppermost extent of the latch is substantially flush with a top surface of the first and second terminal mounts, wherein the latch is connected to the base wall by a fulcrum, the latch having a cantilevered arm connected to the fulcrum, the arm having opposite first and second ends, an engaging member at the first end of the arm, the engaging member being capable of engaging with an associated circuit board, and an actuation shoulder at the second end of the arm, the actuation shoulder configured to be engaged for depression, and wherein each terminal mount extends along part of the length of the base wall such that a platform is formed by the upper surface of the base wall rearwardly of the terminal mounts, and further comprising a latch protection wall extending from each terminal mount to the rear end of the base wall, the latch protection wall being proximate to the actuation shoulder of the latch.

14. An edge connector of configured to connect to a circuit board, the edge connector comprising:

a base wall having a front edge, a rear edge, an upper surface and a lower surface;

a first terminal mount extending upwardly from the upper surface of the base wall, the first terminal mount having a plurality of first passageways extending therethrough;

first terminals mounted in the plurality of first passageways;

a second terminal mount extending upwardly from the upper surface of the base wall, the second terminal mount being spaced from the first terminal mount, the second terminal mount having a plurality of second passageways extending therethrough;

second terminals mounted in the plurality of second passageways; and a moveable latch extending from the upper surface of the base wall, the latch positioned between the first and second terminal mounts, wherein the first terminal mount includes a pair of first outer side walls, at least one first dividing wall provided between the first outer side walls and spaced from the first outer side walls, and a first top wall attached to an upper end of each of the first outer side and dividing walls, the first outer side, dividing and top walls forming the plurality of first passageways through the first terminal mount, and the first outer side, dividing and top walls forming a first circuit board receiving slot at a front end of the first terminal mount; and wherein the second terminal mount includes a pair of second outer side walls, at least one second dividing wall provided between the second outer side walls and spaced from the second outer side walls, and a second top wall attached to an upper end of each of the second outer side and dividing walls, the second outer side, dividing and top walls forming the plurality of second passageways through the second terminal mount, and the second outer side, dividing and top walls forming a second circuit board receiving slot at a front end of the second terminal mount, the second circuit board receiving slot aligning with the first circuit board receiving slot.

15. An edge connector configured to connect to a circuit board, the edge connector comprising:

a base wall having a front edge, a rear edge, an upper surface and a lower surface;

a first terminal mount extending upwardly from the upper surface of the base wall, the first terminal mount having a plurality of first passageways extending therethrough;

first terminals mounted in the plurality of first passageways;

a second terminal mount extending upwardly from the upper surface of the base wall, the second terminal mount being spaced from the first terminal mount, the second terminal mount having a plurality of second passageways extending therethrough;

second terminals mounted in the plurality of second passageways; and a moveable latch extending from the upper surface of the base wall, the latch positioned between the first and second terminal mounts, wherein an uppermost extent of the latch is substantially flush with a top surface of the first and second terminal mounts, and wherein the first and second outer side and dividing walls have recesses therein configured to engage the first and second terminals, respectively.

16. The edge connector of claim 15, wherein one of the first outer side walls has a width which is wider than one of the second outer side walls.

* * * * *